US006974331B2

(12) United States Patent
Brown et al.

(10) Patent No.: US 6,974,331 B2
(45) Date of Patent: Dec. 13, 2005

(54) SOCKET CONNECTOR CARRYING FLEXIBLE CONTACTS

(75) Inventors: John Bossert Brown, Ann Arbor, MI (US); Matthew Richard McAlonis, Elizabethtown, PA (US); Justin Shane McClellan, Camp Hill, PA (US); James Charles Shiffler, Hershey, PA (US); David Charles Martin, Mechanicsburg, PA (US); Michael Anthony Correll, Middletown, PA (US); Peter Paul Wilson, Palmyra, PA (US); Attalee S. Taylor, Palmyra, PA (US); Brett Charles Miller, East Berlin, PA (US); Troy Everette Conner, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 26 days.

(21) Appl. No.: 10/603,227

(22) Filed: Jun. 25, 2003

(65) Prior Publication Data

US 2005/0009380 A1 Jan. 13, 2005

(51) Int. Cl.[7] ..... H01R 9/09

(52) U.S. Cl. ..... 439/66

(58) Field of Search ..... 439/83, 66, 71, 439/862, 444

(56) References Cited

U.S. PATENT DOCUMENTS

| | | | | |
|---|---|---|---|---|
| 5,419,710 | A * | 5/1995 | Pfaff | 439/71 |
| 6,016,254 | A * | 1/2000 | Pfaff | 439/71 |
| 6,083,013 | A * | 7/2000 | Yamagishi | 439/71 |
| 6,454,588 | B1 * | 9/2002 | Pickles et al. | 439/862 |
| 6,652,329 | B1 * | 11/2003 | Howell et al. | 439/862 |

* cited by examiner

*Primary Examiner*—Briggitte R. Hammond

(57) ABSTRACT

A socket connector including a socket base having a slot oriented at a first angle with respect to a bottom surface of the socket base. The socket connector also includes a contact having a base beam and a retention portion. The retention portion forms an initial angle with the base beam before the contact is assembled with the socket base that differs from the first angle. The socket base receives the contact with the retention portion held in the slot such that an angle between the base beam and the retention portion is changed from the initial angle.

15 Claims, 5 Drawing Sheets

SOCKET CONNECTOR CARRYING FLEXIBLE CONTACTS

BACKGROUND OF THE INVENTION

The present invention generally relates to a socket connector for connecting a circuit board and a processor. More particularly, certain embodiments of the present invention relate to flexible contacts that accommodate differing co-efficients of thermal expansion while remaining coplanar in a socket connector.

Many large electronic devices, such as computers, use socket connectors to connect different electronic components. For example, land grid array (LGA) socket connectors are used to electrically connect electronic packages, such as processors, to circuit boards. The conventional socket connector includes a frame surrounding a base. The base includes an array of holes therein that hold contacts in a pattern that corresponds to a pattern of electrical traces provided on the circuit board and contact pads provided on the bottom of the processor. The socket connector is mounted on the circuit board with the contacts engaging the electrical traces. The processor is then positioned on the base with the processor contact pads aligned and engaging the contacts to facilitate electrical communication between the processor and the circuit board.

The contacts are retained in vertical channels in the base of the socket connector. Each contact has a vertical support beam that is formed perpendicularly at a first end with a base beam carrying a solder ball. The support beam is also formed at an opposite second end at an obtuse angle with a contact beam. The support beam and the base beam are generally the same thickness, yet the support beam includes retention barbs that extend from opposite sides thereof. Each contact is inserted into a channel in the base with the retention barbs engaging channel walls to retain the contact within the channel. The contact beam extends out of the channel at an acute angle with respect to a top surface of the base. The base beam extends beyond a bottom surface of the base in a direction generally parallel to the base. The base beam suspends the solder ball under the base.

In operation, a socket cover is mounted to the socket connector. A tool is attached through a vacuum to a top surface of the socket cover and transports the socket cover and socket connector onto the circuit board with the solder balls resting on the electrical traces on the circuit board. The socket connector and socket cover are placed in a reflow soldering oven, which effectively solders the solder balls to the electrical traces on the circuit board. The socket cover is then removed and the processor is positioned on the socket connector with the contact pads engaging corresponding contact beams.

However, conventional socket connectors suffer from several drawbacks. First, the support beams on the contacts do not hold the base beams firmly against the bottom surface of the base. For example, the base beams are manufactured to be at right angles to the support beams and the channels are manufactured to be at right angles to the bottom surface. However, manufacturing tolerances cause the contact and the base to have an acute angle therebetween. Therefore, some of the base beams will extend beyond the bottom surface at a slight acute angle. Thus, the base beams and solder balls are not all coplanar along the bottom surface of the base. When the contacts and solder balls are not entirely coplanar, some of the solder joints between the contacts and the circuit board that are produced during reflow soldering are incomplete or even open. Improper solder joints result in a poor electrical connection between the processor and the circuit board.

Additionally, the rigid manner in which the support beam holds each contact in the corresponding channel prevents the contact from accommodating the effects of differing co-efficients of thermal expansion among the contact, base, and circuit board. For example, the contact may expand at a greater rate than the base and circuit board during temperature changes. Because the contact cannot axially flex within the channel to adjust for such expansion, the contact applies greater resistant forces on the base and the circuit board, which can lead to strains in the base and damaged connections at the solder joints.

Also, because the socket cover covers the contacts in the base, the socket cover blocks heat from reaching the solder balls during the reflow soldering process. Thus, the socket cover can cause poor or even open solder joints between the solder balls and the circuit board.

A need exists for a socket connector that addresses the above noted problems and others experienced heretofore.

BRIEF SUMMARY OF THE INVENTION

Certain embodiments of the present invention include a socket connector having a socket base with a slot oriented at a first angle with respect to a bottom surface of the socket base. The socket connector includes a contact having a base beam and a retention portion. The retention portion forms an initial angle with the base beam before the contact is assembled with the socket base that differs from the first angle. The socket base receives the contact with the retention portion held in the slot such that an angle between the base beam and the retention portion is changed from the initial angle.

Certain embodiments of the present invention include a socket connector having a base with a first co-efficient of thermal expansion. The socket connector includes a contact having a second co-efficient of thermal expansion differing from the first co-efficient of thermal expansion. The contact includes a retention portion formed at one end of the contact and a contact arm formed at an opposite end of the contact. The retention portion is secured to the base to permit relative movement between the contact and base during temperature changes.

Certain embodiments of the present invention include a socket connector having a base carrying a contact. The contact includes a contact arm extending beyond a top surface of the base. The contact includes a base beam extending beyond a bottom surface of the base. The base beam is configured to carry a solder ball. The socket connector includes a socket cover releasably connected to the base proximate the top surface and covering the contact arm. The socket cover has a rigid top surface that contains heat transfer apertures configured to permit heat to transfer to the contact when the solder ball is reflow soldered to a mating pad.

Figure 1:
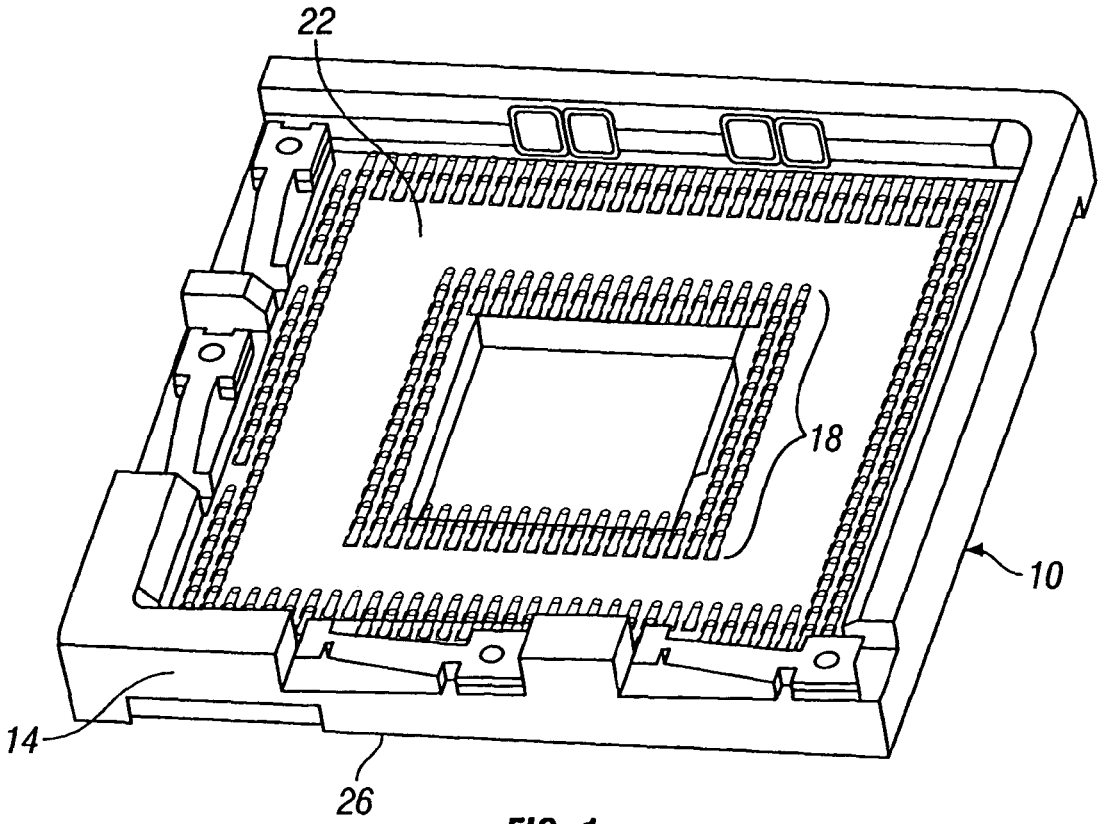
FIG. 1 illustrates a top isometric view of a socket connector formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a top isometric view of a socket connector 10 formed according to an embodiment of the present invention. The socket connector 10 is used in land grid array (LGA) socket applications. The socket connector 10 includes a base 14 that carries an array of contacts 18. The contacts 18 extend through the base 14 and project beyond a top surface 22 and beyond a bottom surface 26. In operation, the socket connector 10 is mounted to a printed circuit board (not shown) and the contacts 18 extending beyond the bottom surface 26 are soldered to the printed circuit board. The socket connector 10 then receives a processor (not shown) having an array of contact pads on a bottom side that correspond to the array of contacts 18 in the base 14. When the processor is positioned on the socket connector 10, the contact pads on the processor engage the contacts 18 to electrically connect the processor to the printed circuit board.

Figure 2:
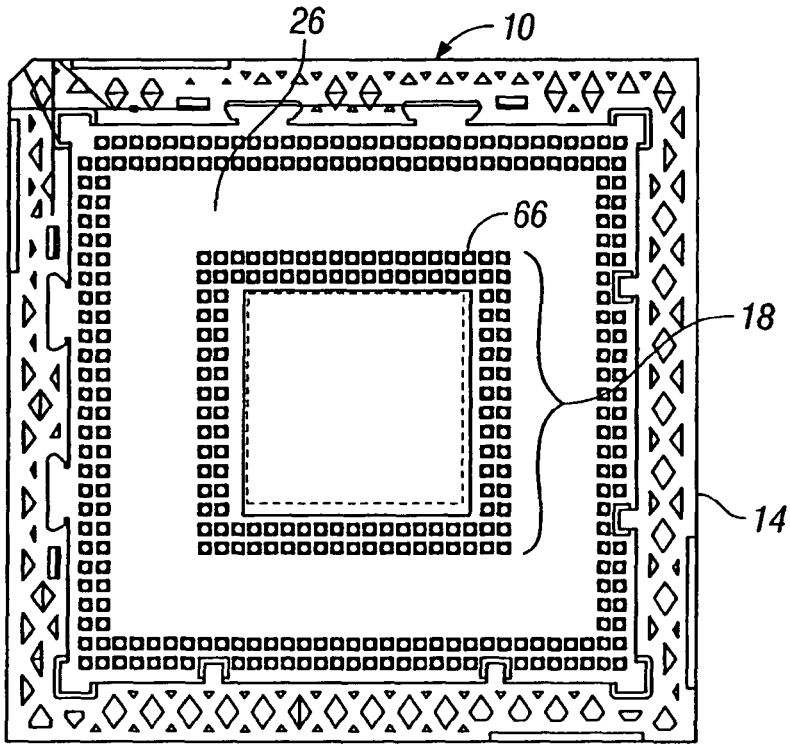
FIG. 2 illustrates a bottom view of the socket connector of FIG. 1.

FIG. 2 illustrates a bottom view of the socket connector 10 of FIG. 1. The contacts 18 have solder balls 66 that extend beyond the bottom surface 26 of the base 14. When the socket connector 10 is positioned on the printed circuit board, the solder balls 66 are soldered to electrical traces on the printed circuit board. Thus, the solder balls 66 electrically connect the contacts 18 to the printed circuit board and retain the socket connector 10 to the printed circuit board.

Figure 3:
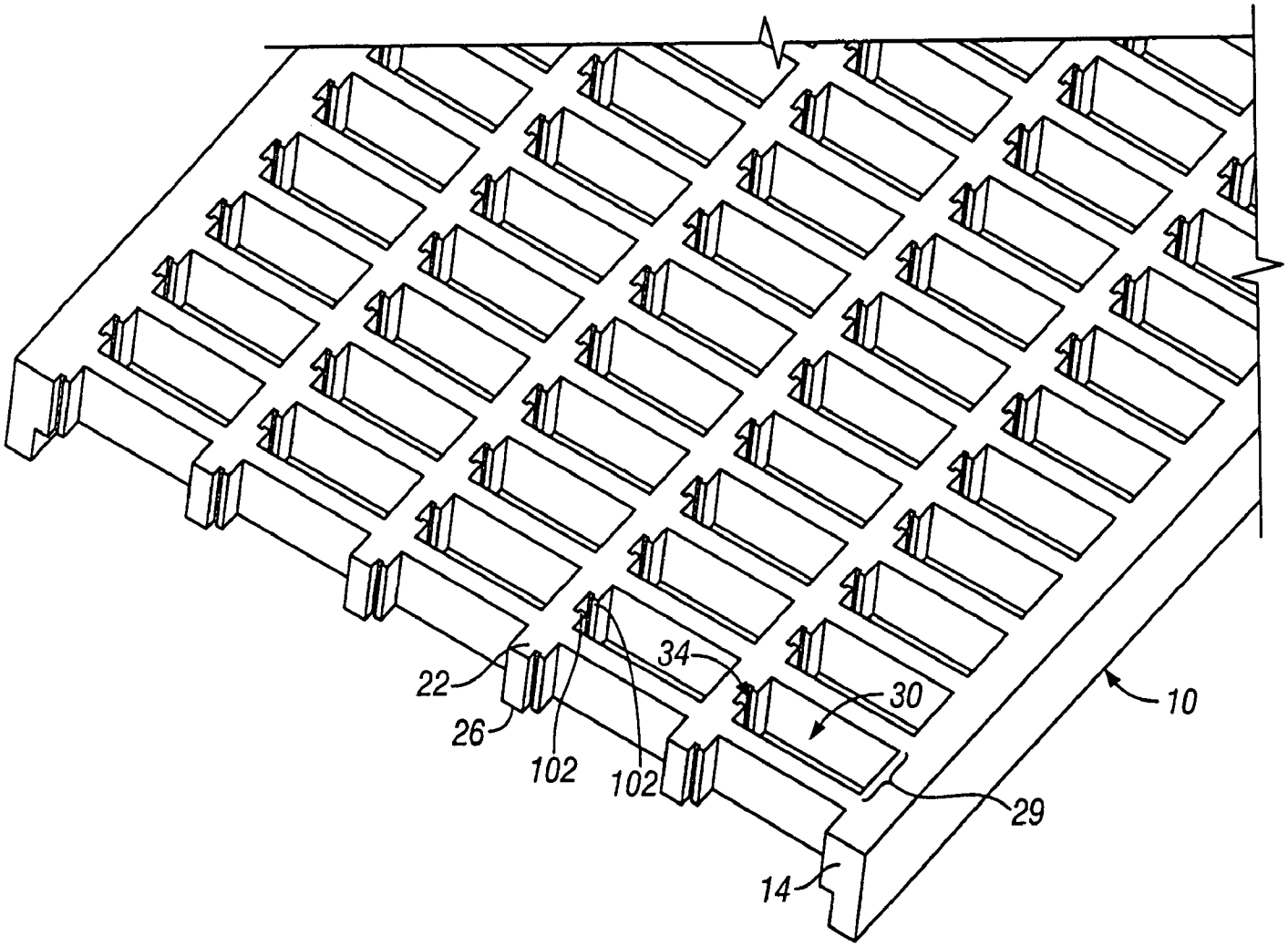
FIG. 3 illustrates a partial isometric cutaway view of a socket connector with contacts removed therefrom formed according to an embodiment of the present invention.

FIG. 3 illustrates a partial isometric cutaway view of the socket connector 10 with the contacts 18 removed therefrom. The base 14 is divided into multiple rows 29. Each row 29 is formed with a series of channels 30 and slots 34 alternately arranged in the base 14. The channels 30 and slots 34 extend between the top and bottom surfaces 22 and 26 of the base 14. Each channel 30 is associated with a slot 34 to hold a corresponding contact 18 within the base 14. Each slot 34 is formed with side walls 102 that separate the slot 34 from a corresponding channel 30.

Figure 4:
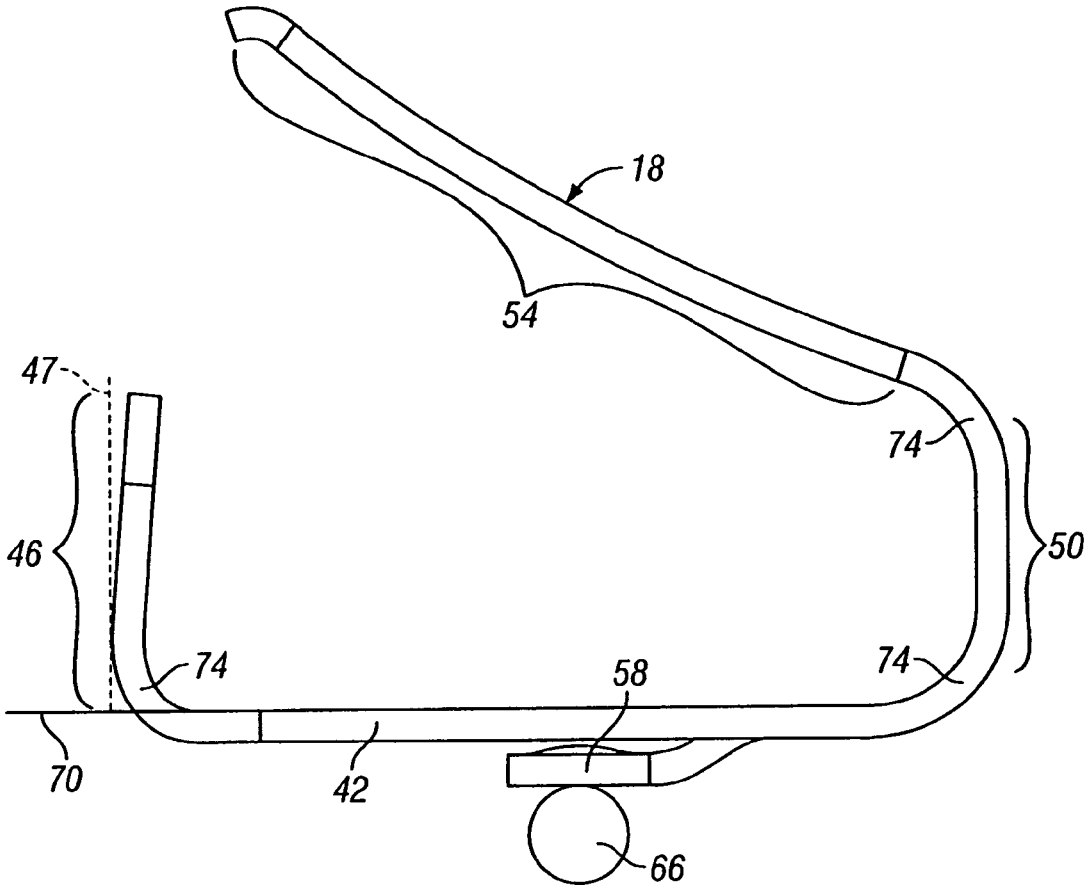
FIG. 4 illustrates a side view of a contact formed according to an embodiment of the present invention.

FIG. 4 illustrates a side view of a contact 18 formed according to an embodiment of the present invention. The contact 18 has a base beam 42 formed with a retention portion 46 at one end and a support portion 50 at an opposite end. A contact arm 54 extends outward and upward from the support portion 50 at an obtuse angle to the support portion 50. A carrier beam 58 is joined at an intermediate point to the base beam 42. The carrier beam 58 extends downward from, and is bent to be oriented parallel to, the base beam 42. The carrier beam 58 carries a solder ball 66. The retention portion 46 forms a slightly acute angle with an axis 47 aligned perpendicular to a contact seating plane 70 that extends along the base beam 42. By way of example only, the retention portion 46 forms an eighty-five degree angle with the contact seating plane 70. The support portion 50 is generally perpendicular to the contact seating plane 70 and the carrier beam 58 is generally parallel with the contact seating plane 70. The retention portion 46 and support portion 50 form rounded corners 74 with the base beam 42 and the support portion 50 likewise forms a rounded corner 74 with the contact arm 54.

Figure 5:
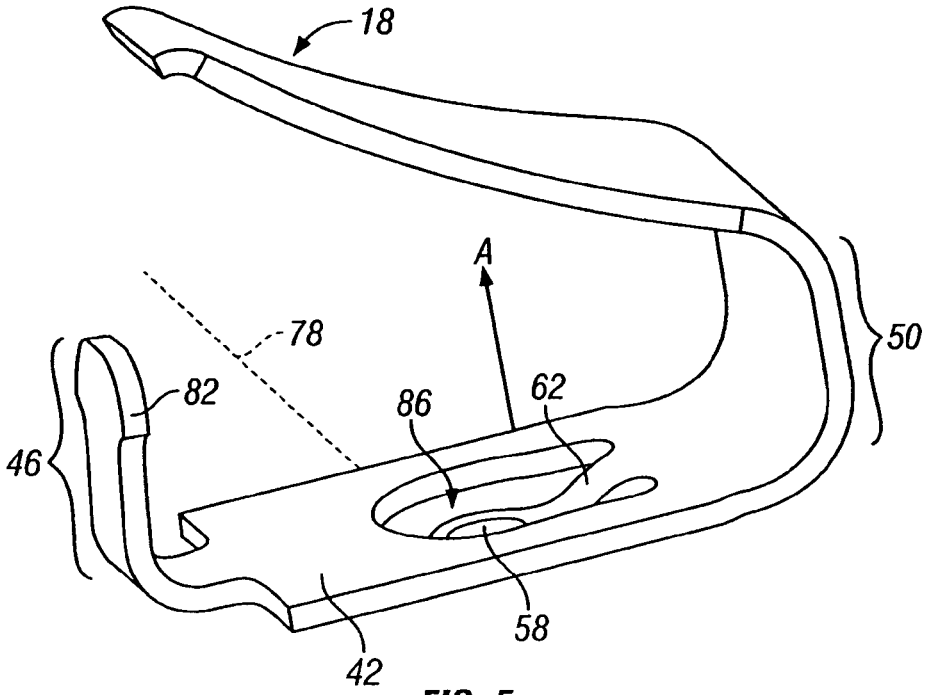
FIG. 5 illustrates an isometric view of the contact of FIG. 4.

FIG. 5 illustrates an isometric view of the contact 18 of FIG. 4. The retention portion 46 is narrower than the base beam 42 along a transverse axis 78 and the support portion 50 is generally the same width as the base beam 42 along the transverse axis 78. The difference in width renders the retention portion 46 more flexible than the base beam 42 or the support portion 50. Also, the base beam 42 may be biased from the retention portion 46 at the point where the retention portion 46 extends from the base beam 42. The retention portion 46 also includes retention barbs 82 extending from opposite sides thereof. The carrier beam 58 may be stamped from the base beam 42, except for an arm 62, to form a middle gap 86. The carrier beam 58 may be deflected upward in the direction of arrow A into the gap 86 at the flexible arm 62.

Figure 6:
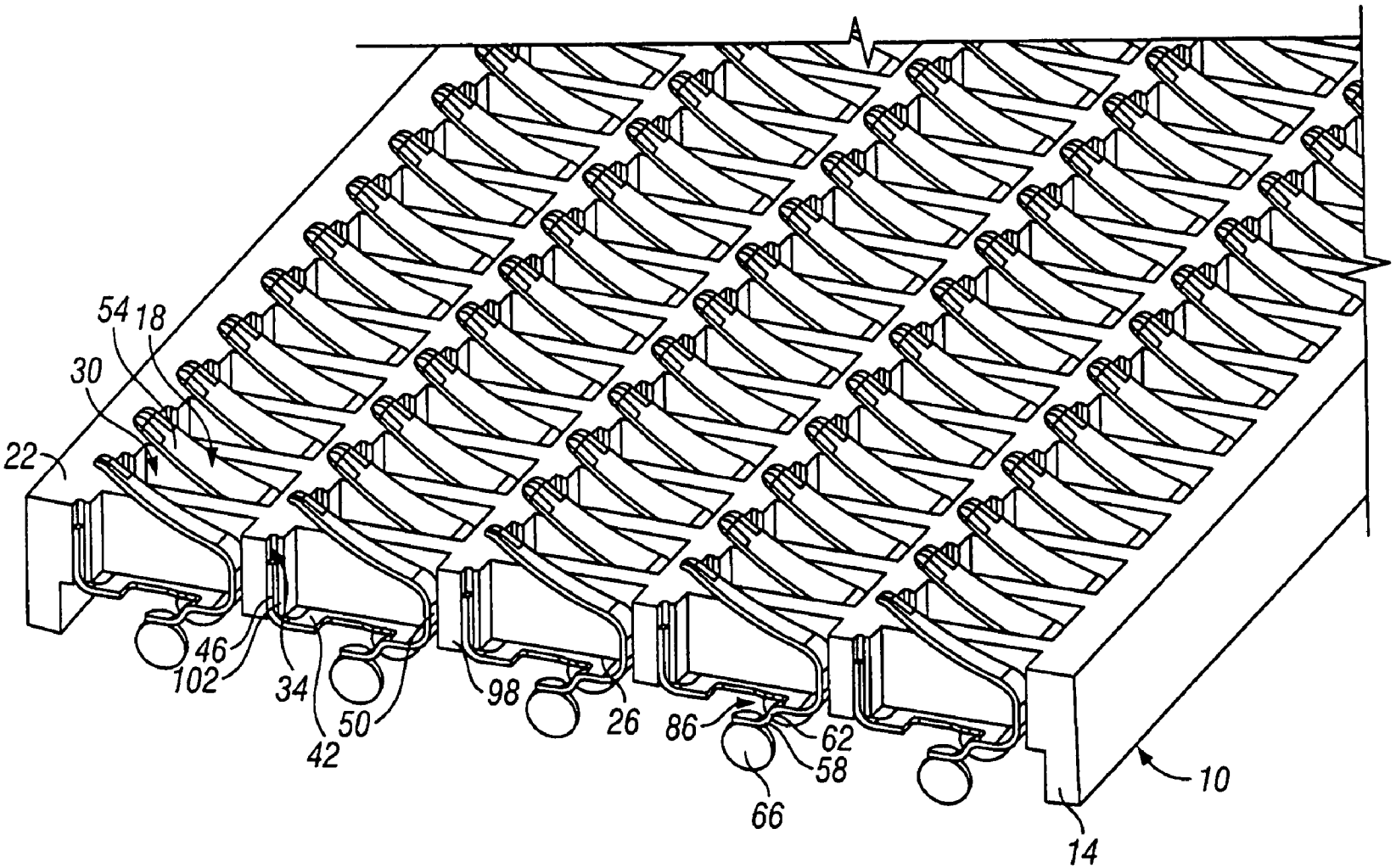
FIG. 6 illustrates a partial isometric cutaway view of a socket connector with an array of contacts exposed according to an embodiment of the present invention.

FIG. 6 illustrates a partial isometric cutaway view of the socket connector 10 with a portion of the array of contacts 18 exposed. During assembly, a contact 18 is inserted into the base 14 by extending the contact arm 54 through the channel 30 with the contact arm 54 projecting through the top surface 22 of the base 14 at an acute angle to the top surface 22. The support portion 50 slides along a first end wall 98 of the retention channel 30. The retention portion 46 is snugly received in the slot 34 and the retention barbs 82 (FIG. 5) engage the base 14 from within the slot 34 to hold the contact 18 within the channel 30. A portion of the base beam 42 extends underneath and engages the bottom surface 26 of the base 14. The base 14 has a first co-efficient of thermal expansion and the contact 18 has a second co-efficient of thermal expansion. The first and second co-efficients of thermal expansion differ from one another.

The slot 34 is partially separated from the corresponding channel 30 by the side walls 102, which are perpendicular to the bottom surface 26 of the base 14. Because the base beam 42 is biased away from the retention portion 46, the base beam 42 firmly engages, and exerts a force upon, the bottom surface 26 of the base 14. All of the contacts 18 are manufactured with the retention portion 46 forming an angle with the base beam 42 such as an acute angle, for example, eighty-five degrees. The retention portion 46 and the base beam 42 are formed at an initial acute angle with respect to one another when the contact 18 is relaxed in an unbiased state, before assembly with the base 14. Therefore, when contacts 18 are manufactured with slightly different dimensions, they still will be biased out of the initial angle, once inserted into the slots 34, such that all base beams 42 firmly and flushly engage the bottom surface 26 of the base 14. Thus, the base beams 42 are maintained coplanar with one another and with the bottom surface 26 of the base 14 and the solder balls 66 are all coplanar as well.

The socket connector 10 is then mounted on the printed circuit board and the solder balls 66 are soldered to the electrical traces on the printed circuit board. The solder balls 66 are coplanar when positioned on the printed circuit board, however, as the solder balls 66 are soldered to the electrical traces, the individual carrier beams 58 may flex upward at the arms 62 toward the gaps 86 to adjust for movement by the solder balls 66 during the soldering process. Thus, by permitting relative motion between the contacts 18 and the printed circuit board, the arms 62 accommodate differing tolerances for each solder ball 66 during the soldering process without affecting the coplanar relation of the base beams 42.

The width and positioning of the retention portions 46 and the base beams 42 allow the contacts 18 to flexibly adjust for differing co-efficients of thermal expansion among the printed circuit board, contacts 18, and base 14. First, the retention portion 46 of a contact 18 is held in the slot 34 by the retention barbs 82 (FIG. 5) and is connected to the base beam 42 by a thin metal strip. Additionally, the retention portion 46 is isolated from the support portion 50 and contact arm 54 by locating the support portion 50 on the opposite side of the channel 30 from the retention portion 46. Thus, the retention portion 46 does not rigidly retain the contact 18 within the channel 30. Therefore, the retention portion 46 permits relative movement between the contact 18 and the base 14 during temperature changes. More specifically, the retention portion 46 permits relative movement between the base beam 42 and the base 14 during temperature changes. Further, when the contact 18 expands at a faster rate than the base 14 or printed circuit board due to thermal changes, the retention portion 46 allows the contact 18 to flex within the channel 30 and between the processor and the printed circuit board with minimal changes in forces between the contact 18 and the printed circuit board and the base 14. If the retention portion 46 rigidly held the contact 18 within the base 14, the expanding contact 18 would apply greater forces to the base 14 and printed circuit board.

Figure 7:
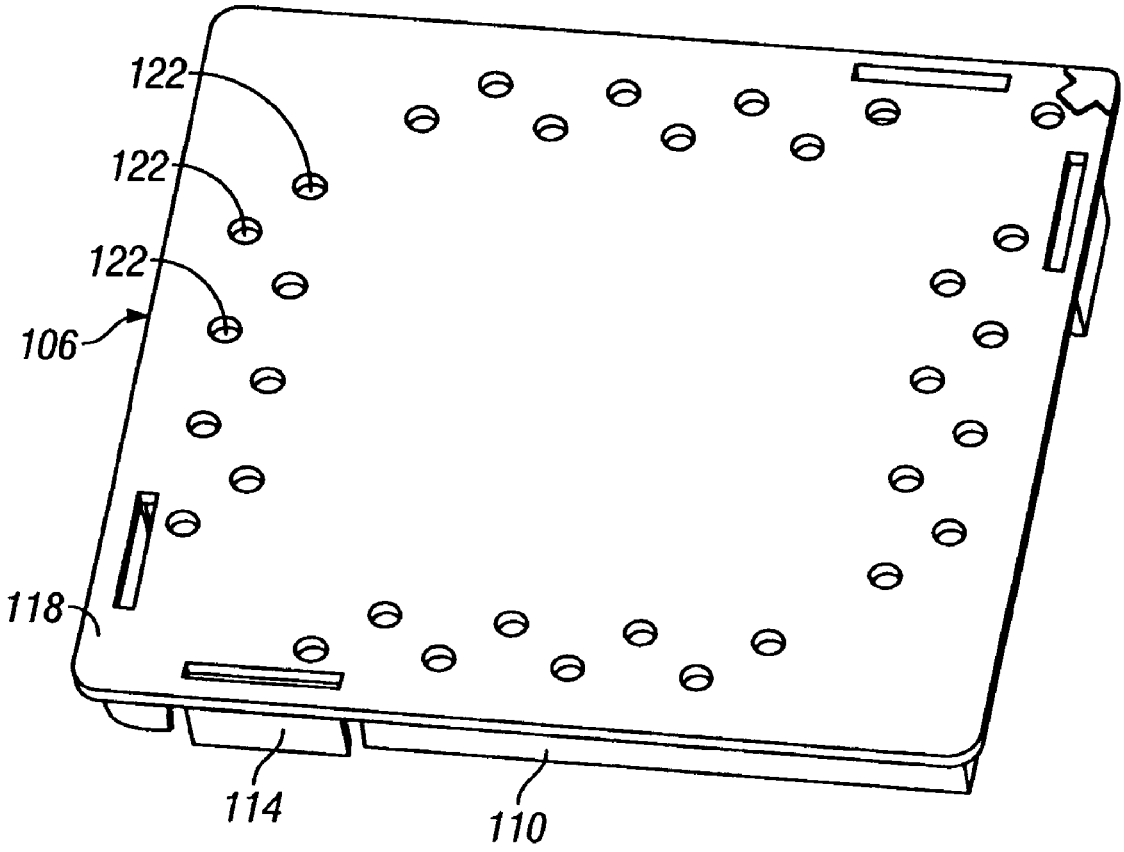
FIG. 7 illustrates an isometric view of a socket cover formed according to an embodiment of the present invention.

FIG. 7 illustrates an isometric view of a socket cover 106 formed according to an embodiment of the present invention. The socket cover 106 is generally rectangular in shape and has side walls 110 and flexible latches 114 extending perpendicularly from a top plate 118. The top plate 118 has apertures 122 along peripheral edges thereof. In operation, the socket cover 106 is snapably secured to the socket connector 10 (FIG. 1) by the latches 114. A transportation tool (not shown) is then used to form a vacuum seal with the top plate 118 and transport the socket cover 106 and the socket connector 10 to the printed circuit board and mount the socket connector 10 on the printed circuit board. The transportation tool is then disengaged from the socket cover 106, and the socket connector 10 undergoes reflow soldering with the socket cover 106 still attached thereon. During reflow soldering, the socket connector 10 is placed in a reflow oven which generates heat at temperatures necessary to solder the solder balls 66 (FIG. 2) to the printed circuit board. The apertures 122 in the top plate 118 allow for the transfer of heat through the top plate 118 to the solder balls 66 and thus facilitate the soldering process.

The apertures 122 formed in the top plate 118 may be a variety of sizes and shapes. For example, the apertures 122 may be circles, triangles, squares, or any number of other geometric shapes. Additionally, the apertures 122 may be located at different points on the top plate 118 and may be positioned about the socket cover 106 in a variety of different patterns, arrays, or alignments. For example, the apertures 122 may be located closer to the center of the top plate 118 than the peripheral edges. As long as the apertures 122 adequately permit the transfer of heat to the contacts 18 (FIG. 2), the apertures 122 may be located anywhere in the top plate 118.

Optionally, the slot 34 may not be at a right angle with the bottom surface 26 of the base 14. For example, the slot 34 may form a ninety-five degree angle with the bottom surface 26 and the base beam 42 may form a right angle with the retention portion 46. Thus, when the retention portion 46 is inserted into the slot 34, the base beam 42 is biased away from the retention portion 46 such that the base beam 42 firmly presses against the bottom surface 26 of the base 14. Likewise, the slot 34 may form an eighty-five degree angle with the bottom surface 26 and the base beam 42 may form an eighty degree angle with the retention portion 46. As long as the angle of the slot 34 to the bottom surface 26 is slightly larger than the initial angle of the retention portion 46 to the base beam 42, the slot 34 will tightly hold the base beam 42 against the bottom surface 26.

In another embodiment the retention portion 46 is thicker than the base beam 42 along the transverse axis 78 and the support portion 50 is generally the same thickness as the base beam 42 along the transverse axis 78. The base beam 42 may be axially biased from the retention portion 46 at the point where the retention portion 46 extends from the base beam 42. Therefore, the retention portion 46 allows the contact 18 to axially flex within the base 14 to accommodate expansion and contraction due to temperature changes.

Certain embodiments of the present invention provide several benefits. When the contact 18 is relaxed, the retention portion 46 is formed at an acute angle to the base beam 42 in order that, upon insertion into the slot 34, the base beam 42 will firmly engage the bottom surface 26 of the base 14. This enables all of the base beams 42 to be coplanar along the bottom surface 26 as long as the contacts 18 are manufactured with the retention portions 46 forming a smaller angle with the base beams 42 than the slots 34 form with the bottom surface 26. Optimally, if the slots 34 are formed at an obtuse or acute angle with respect to the bottom surface 26, the relaxed, initial angle between the retention portions 46 and the base beams 42 merely need be a lesser obtuse or acute angle. Secondly, the retention portions 46 are flexibly formed with the base beams 42 in order that the contacts 18 can flexibly move within the base 14 to accommodate differences in co-efficients of thermal expansion. Finally, the socket cover 106 allows heat from the reflow oven to reach the contacts 18 to enable the proper soldering of the solder balls 66 to the printed circuit board.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A socket connector, comprising:

a socket base having a slot oriented at a first angle with respect to a bottom surface of said socket base; and a contact having a base beam and a retention portion, said retention portion forming an initial angle with said base beam before said contact is assembled with said socket base that differs from said first angle, said socket base receiving said contact with said retention portion held in said slot such that an angle between said base beam and said retention portion is changed from said initial angle, wherein said socket base includes a channel proximate said slot, said channel being defined by an end wall opposite said slot, said contact including a support portion joining said base beam with a contact arm, said support portion of said contact abutting against said end wall of said channel.

2. The socket connector of claim 1, wherein said retention portion includes retention barbs extending from sides thereof, said retention barbs frictionally engaging said slot to retain said contact within said socket base.

3. The socket connector of claim 1, further including a socket cover configured to be engaged by a transport tool, said socket cover being releasably connected to said socket base and covering said contact, said socket cover having a rigid top surface that contains apertures to permit heat transfer to said contact to facilitate soldering of said contact to a circuit board.

4. The socket connector of claim 1, wherein said retention portion is narrower than said base beam such that said base beam is flexibly formed at one end with said retention portion.

5. The socket connector of claim 1, further comprising a plurality of said contacts, wherein said base beam for each of said contacts abuts against said bottom surface of said socket base to maintain said base beams coplanar with one another in a contact seating plane.

6. The socket connector of claim 1, further comprising a plurality of said contacts, wherein said base beam for each of said contacts carries a solder ball, said base beams abutting against said bottom surface of said socket base to maintain said solder balls coplanar with one another.

7. The socket connector of claim 1, wherein said base beam includes a flexible arm extending downward therefrom and spaced apart from said bottom surface, said flexible arm being configured to receive a solder ball.

8. The socket connector of claim 1, wherein said base beam and said retention portion form said initial angle with one another when said contact is in a relaxed, unbiased condition.

9. The socket connector of claim 1, wherein when said contact is mounted to said socket base, said angle between said retention portion and said base beam increases.

10. A socket connector, comprising:

a base having a first co-efficient of thermal expansion; and a contact having a second co-efficient of thermal expansion differing from said first co-efficient of thermal expansion, said contact including a retention portion formed at one end of said contact and a contact arm formed at an opposite end of said contact said retention portion being secured to said base to permit relative movement between said contact and base during temperature changes, wherein said contact includes a base beam joined to said retention portion, said base beam moving relative to said base during temperature changes.

11. The socket connector of claim 10, wherein said base includes a slot that is oriented at a first angle with a bottom surface of said base, said base beam being formed with said retention portion at an initial angle that differs from said first angle, said base carrying said contact with said retention portion held in said slot such that said base beam is biased away from said retention portion by said bottom surface of said base.

12. The socket connector of claim 10, further including a transport socket cover releasably connected to said base and covering said contact, said socket cover having a rigid top surface that contains apertures to permit heat transfer to said contact to facilitate soldering of said contact to a circuit board.

13. The socket connector of claim 10, wherein said contact arm is configured to engage a processor and said contact carries a solder ball that is configured to engage a circuit board, said retention portion being remotely located from said contact arm and solder ball to afford said contact arm and solder ball a limited range of motion when said retention portion is retained within said base.

14. The socket connector of claim 10, wherein said contact includes an arm extending downward from said contact to receive a solder ball that is configured to be soldered to a circuit board, said arm permitting relative motion between said contact and a circuit board during soldering.

15. A socket connector, comprising:

a base having a first co-efficient of thermal expansion; and a contact having a second co-efficient of thermal expansion differing from said first co-efficient of thermal expansion, said contact including a retention portion formed at one end of said contact and a contact arm formed at an opposite end of said contact, said retention portion being secured to said base to permit relative movement between said contact and base during temperature changes, wherein said contact includes a base beam that is flexibly joined to said retention portion such that, when said contact expands or contracts due to temperature changes, said base beam flexes with respect to said retention portion.

* * * * *